United States Patent [19]

Bini

[11] 3,996,320

[45] Dec. 7, 1976

[54] METHOD FOR MAKING DOMED SKELETAL STRUCTURES OF CONCRETE

[76] Inventor: Dante Bini, 5-11 Thornton St., Darling Point, New South Wales, Australia

[22] Filed: Nov. 20, 1974

[21] Appl. No.: 525,626

[30] Foreign Application Priority Data

Dec. 17, 1973 Italy ..... 9017/73

[52] U.S. Cl. ..... 264/32; 52/2; 52/81; 249/32; 249/65; 264/35; 264/314

[51] Int. Cl.[2] ..... E04B 1/16; E04B 1/19

[58] Field of Search ..... 264/32, 35, 69, 71, 264/72, 314; 52/2, 80, 81; 249/65, 32

[56] References Cited

UNITED STATES PATENTS

| | | | |
|---|---|---|---|
| 2,881,501 | 4/1959 | Raney | 249/32 X |
| 2,892,238 | 6/1959 | Budd | 249/32 |
| 3,462,521 | 8/1969 | Bini | 264/32 |
| 3,686,818 | 8/1972 | Bini | 264/32 X |

*Primary Examiner*—Robert F. White
*Assistant Examiner*—Thomas P. Pavelko
*Attorney, Agent, or Firm*—Emory L. Groff, Jr.

[57] ABSTRACT

A method of and apparatus for making a self-supporting dome-like skeletal structure including the steps of preparing a substantially flat surface, assembling an array of multi-sided first members which is criss-crossed by paths comprising adjacent flanges of adjacent first members, placing a strip of pliable material along each path and interweaving the strips at intersections thereof, securing the ends of the strips, mounting over each first member a second member of configuration similar to said first member, said second members peripherally sealingly resting on the strips on the flanges of the first members, placing concrete in troughs having as sides the sides of adjacent second members and as bottoms the strips on the flanges of the first members and introducing pressurized gas below said array of first members to cause it to assume a dome-like configuration, allowing the concrete in the troughs to set and exhausting the gas from below the first members so as to strip at least said first members from the concrete skeleton so formed.

4 Claims, 14 Drawing Figures

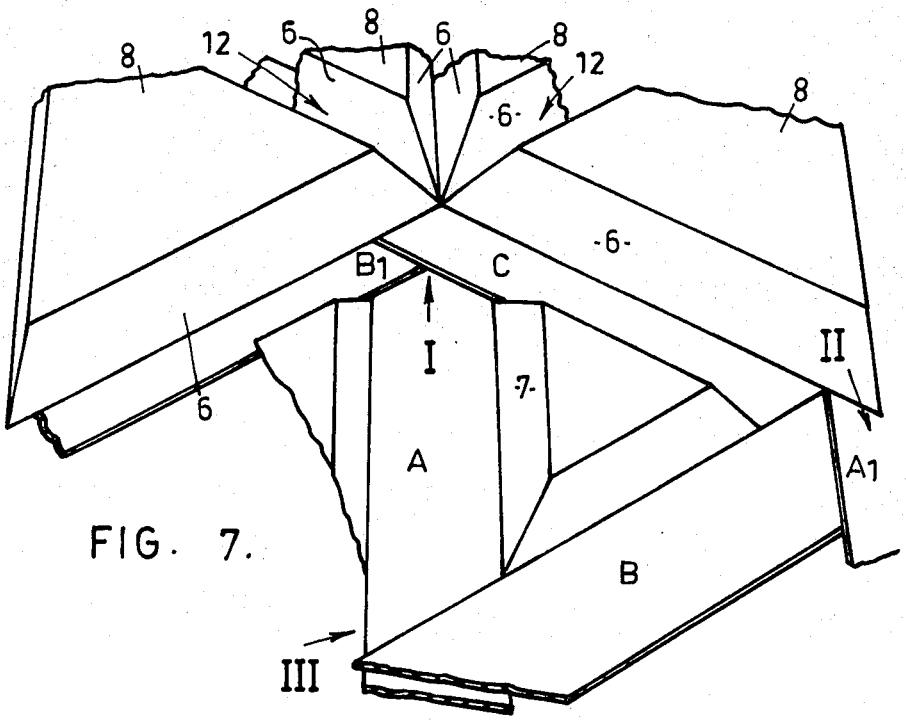
FIG. 7.
FIG. 8.
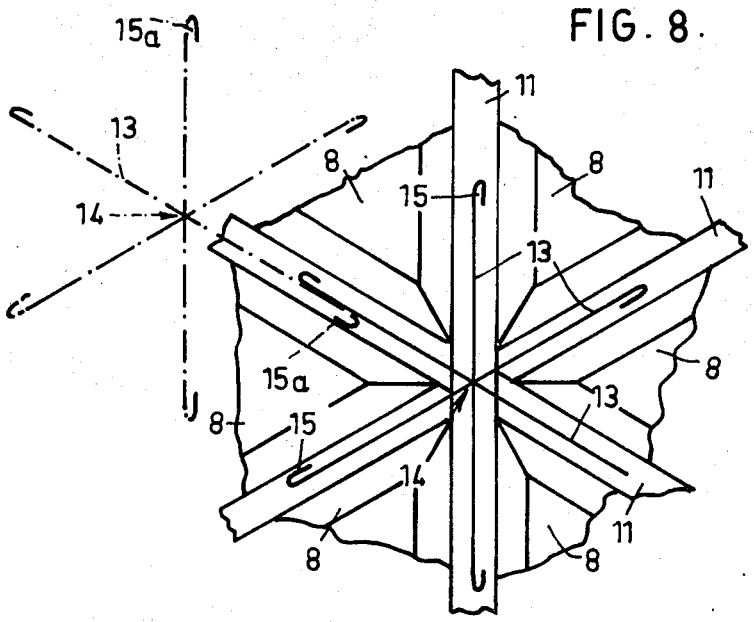

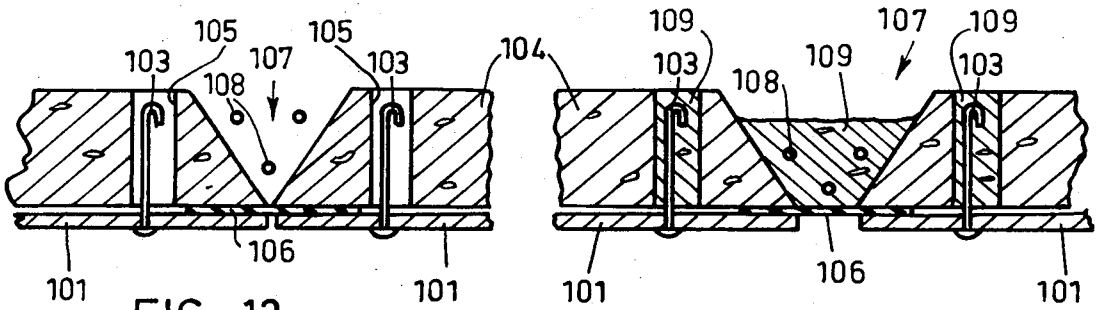
FIG. 12.
FIG. 13.
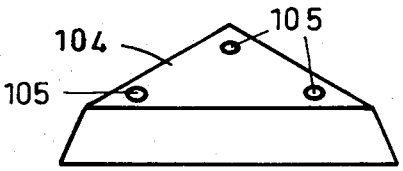
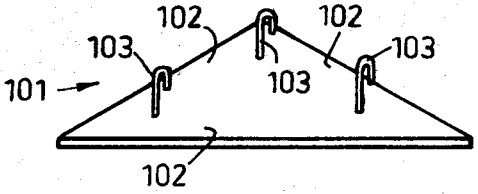
FIG. 14.

METHOD FOR MAKING DOMED SKELETAL STRUCTURES OF CONCRETE

This invention provides a rapid method and apparatus for making a self-supporting dome-like skeletal structure of concrete ribs particularly of very large dimension by inflating a support made up of a plurality of prefabricated members and strips over which structured wet concrete is placed.

A frame of the above type can be used for several purposes, for example as a shade structure, and architectural covering for some outdoor facility, such as a swimming pool, or as a nucleus for a building or industrial plants such as factories. In the latter instance the skeleton would be clad with, for example, aluminium panels or alternatively the interstices of the skeletal frame would be filled with infill panels having decorative and/or weatherproof qualities and/or thermo-acoustic characteristics such as ferrocement panels. The skeleton can also support a continuous roofing system.

Hitherto many dome-like shell structures have been made by using a method invented by the applicant of this new invention involving inflating a unitary membrane on which a layer of wet concrete with internal reinforcement has been placed. The shell was left to set on the inflated membrane which was then deflated and removed. Practical considerations, such as the weight of the membranes and thus the ability of workmen to handle the membrane and also the time required to place and handle vast quantities of concrete have combined to place a practical limit on the size of shells which can be formed by the above method known as Binishells (Trade Mark) system.

By means of the present invention the problems experienced with Binishells constructing system, as set out above, are avoided as there is no unitary membranes required and the amount of concrete for a given surface area covered by a skeletal structure is only a fraction of taht required to form a complete shell over a corresponding area.

With the present invention the highly specialised spring reinforcement system of the Binishells system is not required thereby further simplifying the construction of skeletal structures.

Another very important advantage of the present invention is the saving in time and cost by not using an exterior covering membrane as is required with the Binishells system and the complex vibrating system of the Binishells construction is replaced by simple vibration means.

The present invention also has the advantage that as the outer surface is not covered by an outer membrane the outer surface can be observed at all times thereby enabling any surface faults to be immediately rectified. The time to form the foundation of the Binishells construction represented a considerable percentage of the total time to build a dome by the system. Due to a great simplification of the foundation arrangement second equipment required for the construction of a skeleton dome according to the invention a reduction in the time required has been achieved.

Accordingly, the present invention provides a method of making a self-supporting dome-like skeletal structure including the steps of preparing a substantially flat surface, assembling a plurality of first members each having a multi-sided regular shape and a peripheral flange so that said first members are in flange to flange relationship so as to form an array of first members which is criss-crossed by paths comprising adjacent flanges of adjacent first members, placing a substantially straight continuous strip of pliable material along each path across said array of first members in order to overlie said flanges and cover the joints between said adjacent flanges, interweaving the strips at intersections thereof to form a web of strips, securing the ends of the strips, mounting a second member over each of said first members, said second members having the same number of sides and configuration as the first members but being smaller overall than the first members and peripherally sealingly resting on the strips on the flanges of the first members, placing concrete in troughs having as sides the sides of adjacent second members and as bottoms the strips on the flanges of the first members and introducing pressurised gas below said array of first members to cause it to assume a dome-like configuration, allowing the concrete in the troughs to set and exhausting the gas from below the first members so as to strip at least said first members from the concrete skeleton so formed.

The invention in a presently preferred form will be described with reference to the accompanying drawings in which:

FIG. 7 is a perspective view showing several mould assemblies and one first member and the relationship of strips of pliable material tying the various components together;

FIG. 8 shows schematically a reinforcement assembly mounted in position and in dotted outline another reinforcement assembly to indicate the normal overlapping relationship therebetween;

FIG. 12 is a sectional view of another embodiment of the invention prior to concrete placement;

FIG. 13 is a view similar to FIG. 12 after concrete placement and inflation of the formwork; and FIG. 14 is a perspective view of the first and second members as used in the FIGS. 12 and 13 embodiment.

Figure 1:
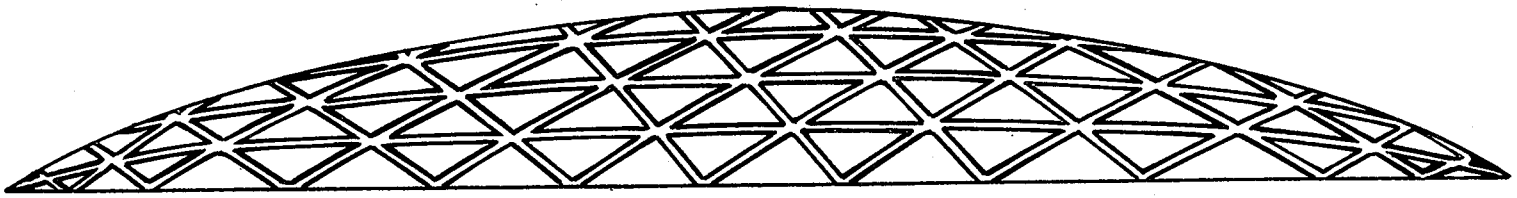
FIG. 1 is a schematic view of a finished structure according to the invention.
Figure 3:
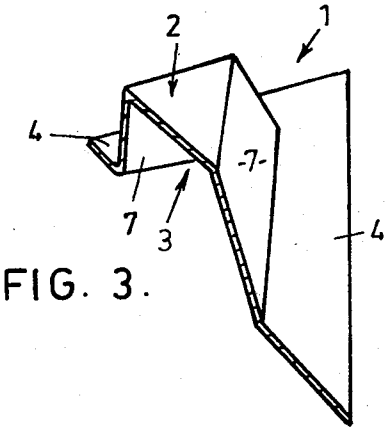
FIG. 3 is a sectional perspective view on the section line 3—3 of FIG. 2.
Figure 2:
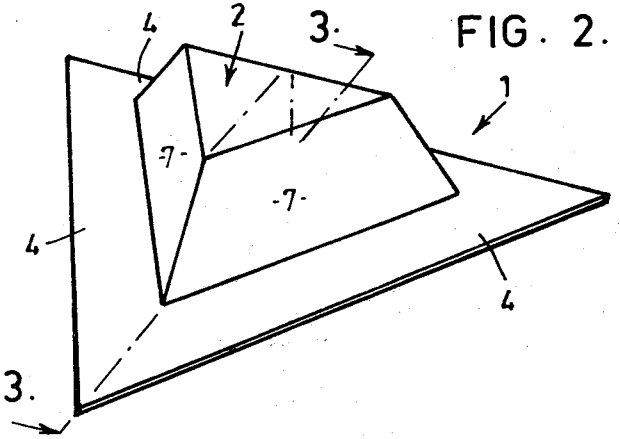
FIG. 2 is a perspective view of the first member of two members comprising a mould assembly.
Figure 4:
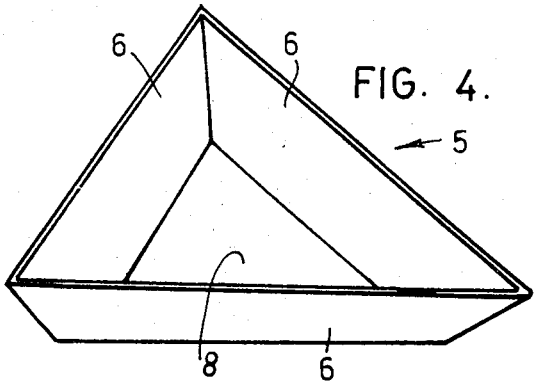
FIG. 4 is an inverted perspective view of the second member of a mould assembly.
Figure 5:
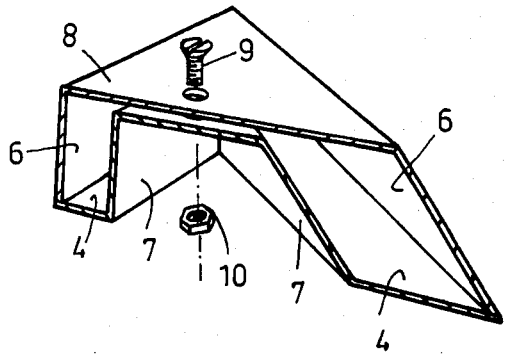
FIG. 5 is a sectional perspective view of a mould assembly.

In the drawings FIG. 1 represents, to a very small scale and schematically, the appearance of a skeletal structure according to the invention. The skeletal structure is formed using a plurality of similar mould assemblies each comprising (as seen in FIGS. 2 and 3) a triangular hollow first member 1 having a triangular body part 2 which is hollow as at 3 and has a continuous peripheral flange 4. The members can be of any suitable material e.g. metal, timber, ferrocement or fibreglass. The sides of the body 2 slope so as to simulate a truncated triangular pyramid. Each mould asembly is completed by a second triangular hollow member 5 (see FIG. 4) which has sides 6 inclined similarly to the sides 7 of member 1 and a top 8. The members 5 can be made of any suitable material e.g. metal, timber, ferrocement or fibreglass. The hollow interior of the member 5 is larger than the body 2 of the member 1 so that when correctly disposed (member 5 over member 1) the relationship is as shown in FIG. 5. In FIG. 5 a nut and screw arrangement 9–10 is illustrated to show one of any number of possible ways of securing the members 1–5 together during a moulding operation as is hereafter described. The edges of the sides 6 of the member 1 may be inturned as at 6a to form flanges (see FIG. 10) to strengthen the sides 6 and so resist the pressure of the concrete.

Figure 6:
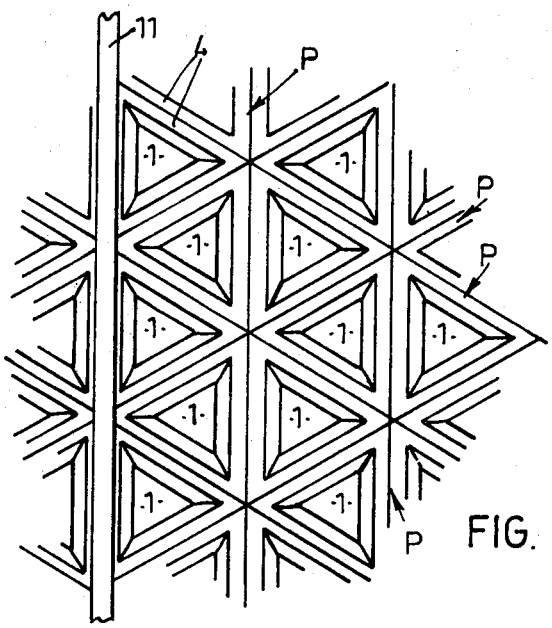
FIG. 6 is a plan view from above of an array of assembled first members.
Figure 9:
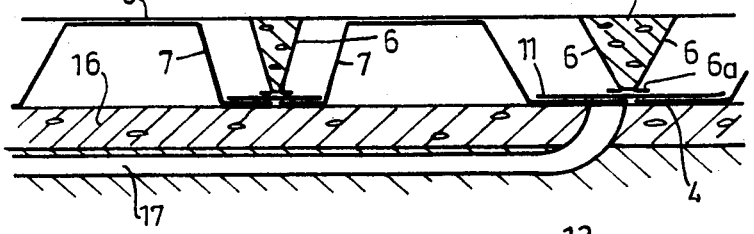
FIG. 9 shows portion of an assembled formwork with concrete in place before the inflation of all the assembled members and strips.
Figure 9:
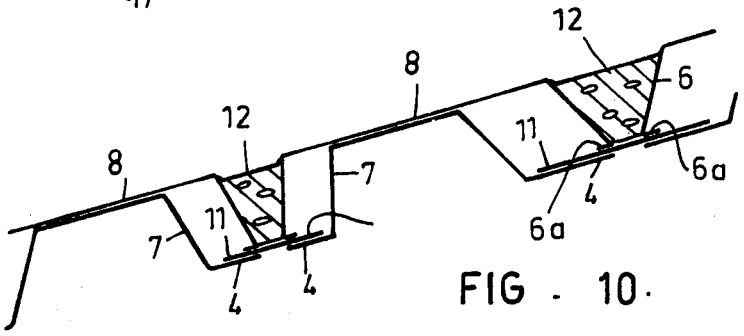
Figure 10:
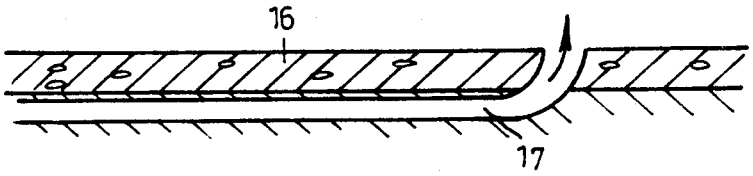
FIG. 10 is a view similar to FIG. 9 showing the formwork partly raised.
Figure 10:
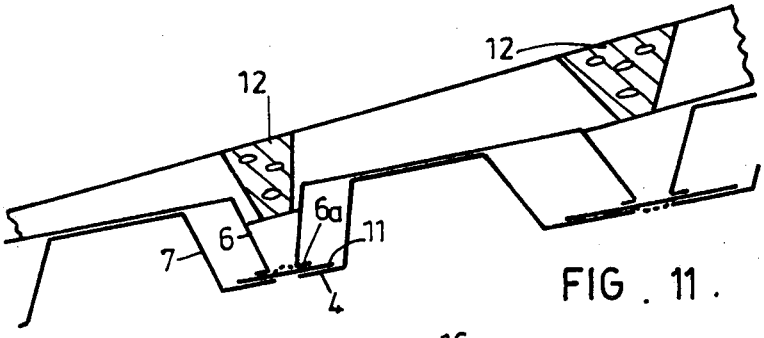
Figure 11:
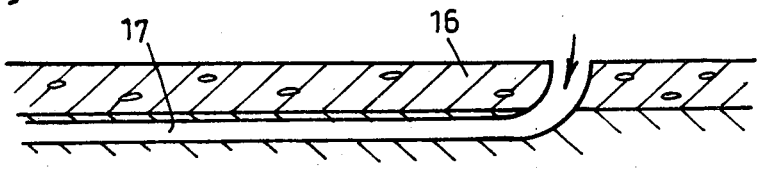
FIG. 11 shows portion of a finished skeletal structure with the formwork in the action of being lowered to strip it off the structure.

The first members 1 are laid out on a prepared surface, which may be a levelled area of ground or a concrete or other base indicated 16 in FIGS. 9 to 11. The flanges 4 of adjacent first members abut to form an array of such members (see FIG. 6) which is thus crisscrossed by a plurality of paths P. Continuous strips of pliable material 11, which are substantially non-extensible, over short lengths, but with limited elasticity are laid out across the array of first members along the paths P and are of sufficient width as to substantially cover the two adjacent flanges 4. The strips 11 where they intersect are "woven" together as seen in FIG. 7. More specifically, at intersection III strip A goes under strip B whereas at intersection II strip A1 goes over strip B which in turn lies over strip C. At intersection I strip C goes over strip B1 which lies over strip A. With such "woven" joints each first member is locked between the strips A, B and C. The ends of the strips A, B and C, A1, A2 etc, B1, B2 etc and C1, C2 etc. are fixed, as for example by clamps (not shown), of any suitable type so that the strips A, B and C etc. are taut. If desired the joints between adjacent flanges can be taped prior to the placement of the strips to ensure sealing of the joints.

Referring now to FIGS. 7 to 11 it will be seen that when the members and strips are assembled V-section troughs 12 are formed (see FIG. 7) and, as can be imagined, the troughs 12 extend in all directions and criss-cross the surface of the array of assembled members which is now a formwork in the troughs of which concrete will be placed. FIG. 7 shows the way in which the strips A, B etc. are clamped firmly between the members 5 and the flanges 4 by the nut and screw arrangement previously referred to, so as to render the assembled members and strips into a substantially air tight formwork. The troughs which are to be filled with concrete also serve to house reinforcing. An elementary reinforcement assembly is illustrated in FIG. 8 and comprises three overlapped reinforcement rods 13 which are bound together as at 14 and each having its ends hooked as at 15. Each hooked end 15 would overlap (as shown in dotted lines) with a hoked end 15a of an adjacent reinforcement rod. If required multiple reinforcement rod assemblies may be used at each intersection of the troughs 12. It is to be understood that the ends of the rods 13 can be straight and the hooked profile 15 is only illustrative of one form of reinforcement rod end treatment.

FIG. 9 shows, diagrammatically, concrete disposed in a typical trough configuration in an assembled formwork mounted over a support surface or paving 16 having a duct 17 therebelow which discharges below the formwork. FIG. 10 shows the formwork partly raised by the introduction of compressed gas (air) along duct 17. It is to be noted that the sides 6 of the members 5 are spaced further apart than they were in FIG. 9 resulting from the movement apart of the pairs of members 1–5 relative to the strips. For this reason the clamping force exerted on the strips should only be sufficient to provide substantially gas tight joints.

The concrete and reinforcement will slump as shown in FIG. 10 as the gap between faces 6 increases. It will be understood that as the formwork rises each reinforcement will move relative to its adjacent reinforcement. For this reason overlapping of the ends of the rods is provided, this ensures double reinforcement where there can be no direct tying of one reinforcement rod to the corresponding rod of an adjacent reinforcement assembly.

In order to provide rapid construction and complete compaction of the concrete it is desirable to vibrate the concrete. This can be done in a number of ways, for example known vibrating machines can be used to vibrate the concrete in the troughs directly or by vibrating the faces 8. Another method of vibration forming a part of this invention is to cause pulses in the air below the assembled members and strips when in an elevated position and/or during the elevation of the assembled members and strips. Pulsing of the atmosphere within the dome will cause slight vibration of the assembled members and strips and this vibration will be transferred to the concrete in the troughs causing it to compact and consolidate. Any method can be adopted for causing the air within the dome to pulse, for example a sound source may be located within the dome and caused to make low frequency sound waves which by travelling through the atmosphere within the dome wll cause the assembled members and strips to vibrate.

It is to be observed that because of the woven arrangement of strips each assembly 1–5 is accurately located and the relative relationships between the assemblies 1–5 remain constant during the upward doming of the formwork despite the resultant separation of the adjacent assemblies 1–5 with associated slight elongation of the strips. Although the strips are pliable they are substantially inextensible over short lengths but have limited elasticity. Slight elastic elongation will occur over considerably long lengths of strip (within the elastic limit of the strip) and in the present instance with strips in the order of 100 meters long and upwards, sufficient elongation (about 10–12%) is obtainable to permit the achieving of the required dome formation.

After the concrete is set the underside of the formwork is evacuated by discharging the inflating gas through the duct 17 and the skeleton shown (in part) in FIG. 11 results. The collapsed formwork may then be dismantled and removed from inside the skeletal structure until required for reuse.

It has been set forth in the specification that the skeletal structure can be used for ornamental purposes or as a basis for a covering over a recreation or working area, this can be done by cladding the skeletal structure or filling the spaces between the ribs of the structure, one filling means is to allow the members 5 to remain in place. Another way of utilising the structure is to suspend a substantially flat ceiling from the skeletal structure by means of cables or rods thereby creating not a domed ceiling but a flat ceiling over the area within the dome. The ceiling can be located at the appropriate height, say 3–5 meters above ground level. By adopting this procedure a saving is achieved in cladding of the structure, the ceiling requiring less material than would be required to clad the structure and at the same time the volume required to be air-conditioned or otherwise environmentally controlled is substantially decreased. It will be seen therefore that with the suspended ceiling construction considerable savings can be achieved whilst providing very large areas of clear span, that is without any interruptions such as posts or columns to hold up the ceiling. Appropriate drainage would be provided in the ceiling to carry away rain and like water. Because of the domed nature of the support structure great strength is provided and quite heavy ceiling structures can therefore be supported by appropriately positioned cables or rods. Although triangular shaped first and second members have been described and illustrated the invention can be carried out with rectangular members or the like.

In the description above emphasis has been placed on the removal and re-use of the members 1 and 5 and the strips 11. In certain circumstances, e.g.: in remote areas of building erection where transport costs are high, or for architectural reasons some or all of the components may be left in the skeletal frame.

It would be possible for example to make the members 5 of durable material and remove members 1 and strips 11. The members 5, for example if cast from ferrocement, could be left as infill panels in the skeletal frame. If required the sides 6 of the members 5 could be exteriorly roughened to ensure a good bond with the concrete of the skeleton.

In another construction, see FIGS. 12 to 14, expendible and simple components are used. These components comprise a first member 101 which would be (as shown) of triangular shape, made of timber, fibreglass, metal or ferrocement or like cement-based material having a peripheral flange 102 and attached up-standing reinforcement rods 103. The second member 104 (made of durable material) would be a triangular truncated pyramid with holes 105 therethrough to accept the rods 103. The rods 103 in the holes 105 generally locate the member 104 relatively to the member 101. Strips 106 are placed and woven as hereinbefore described to hold the members 101 and 104 in place. The strips lie against the sides of the rods 103 which serve as alignment means. Concrete 109 is then positioned in the troughs 107 and in the holes 105 to anchor the rods 103. Reinforcement rods 108 may be used in the troughs 107 in the manner hereinbefore described.

Compressed gas is introduced (as before) below the assembly and it is raised, concrete compacting vibration may be used if required.

After the concrete is set the compressed gas is released and the whole formwork remains in place to become part of the exterior and interior surface treatment of the skeletal frame.

I claim:

1. A method of making a self-supporting dome-like skeletal structure including the steps of preparing a substantially flat surface, assembling a plurality of first members each having a multi-sided regular shape and a peripheral flange so that said first members are in flange to flange relationship so as to form an array of first members which is criss-crossed by paths comprising adjacent flanges of adjacent first members, placing a substantially straight, elastic continuous strip of pliable material along each path across said array of first members in order to overlie said flanges and cover the joints between said adjacent flanges, interweaving the strips at intersections thereof to form a web of strips, securing the ends of the strips, fastening a second member over and to each of said first members, said second members having the same number of sides and configuration as the first members but being smaller overall than the first members and peripherally sealingly resting on the strips on the flanges of the first members, said fastening clamping said pliable material between the flanges of said first and second members, placing concrete in troughs having as sides the sides of adjacent second members and as bottoms the strips on the flanges of the first members and introducing pressurized gas below said array of first members to cause it to raise and assume a dome-like configuration, the pairs of first and second members moving slightly apart relative to said strips as said array is raised, allowing the concrete in the troughs to set and exhausting the gas from below the first members so as to strip at least said first members from the concrete skeleton so formed.

2. The method according to claim 1 wherein a body part of the first members and said second members are truncated equilateral triangularly shaped.

3. A method as claimed in claim 1 including the step of placing a reinforcement member made of elements tied together at each intersection of said strips so as to lie in said troughs with the reinforcement elements extending parallel to the strips and with adjacent elements of adjacent reinforcement members overlapping each other.

4. A method as claimed in claim 1 wherein the second members remain embedded in the concrete to form infill panels for the openings in the concrete skeleton.

* * * * *